US006259206B1

(12) United States Patent
Tsuchiya et al.

(10) Patent No.: US 6,259,206 B1
(45) Date of Patent: Jul. 10, 2001

(54) CATHODE RAY TUBE

(75) Inventors: Yasumasa Tsuchiya; Shinji Murooka, both of Mobara (JP)

(73) Assignees: Hitachi, Ltd., Tokyo; Hitachi Device Engineering Co., Ltd., Chiba-ken, both of (JP)

( * ) Notice: Subject to any disclaimer, the term of this patent is extended or adjusted under 35 U.S.C. 154(b) by 0 days.

(21) Appl. No.: 09/679,868

(22) Filed: Oct. 5, 2000

Related U.S. Application Data

(63) Continuation of application No. 09/292,608, filed on Apr. 15, 1999, now Pat. No. 6,150,760.

(30) Foreign Application Priority Data

Apr. 28, 1998 (JP) ..... 10-118119

(51) Int. Cl.[7] ..... H01J 23/16

(52) U.S. Cl. ..... 315/3; 313/2.1; 313/364; 313/477 R

(58) Field of Search ..... 315/3; 313/2.1, 313/364, 461, 467, 477 R, 479

(56) References Cited

U.S. PATENT DOCUMENTS

| | | | | |
|---|---|---|---|---|
| 3,826,867 | | 7/1974 | Goodman | 313/110 |
| 3,890,507 | | 6/1975 | Goodman | 315/10 |
| 4,471,264 | * | 9/1984 | Matauzaki et al. | 315/3 |
| 4,537,322 | * | 8/1985 | Okada et al. | 313/477 R |
| 4,564,785 | * | 1/1986 | Sato et al. | 313/477 R |
| 4,602,187 | * | 7/1986 | Fischman et al. | 313/479 |
| 4,620,134 | | 10/1986 | Peels et al. | 315/15 |
| 4,785,219 | | 11/1988 | Soemers et al. | 315/3 |
| 4,820,958 | | 4/1989 | Shimoma et al. | 315/368 |
| 5,189,348 | | 2/1993 | Yokota et al. | 315/399 |
| 5,221,875 | | 6/1993 | Odenthal | 315/14 |
| 5,350,973 | | 9/1994 | Yokota et al. | 315/8 |
| 5,818,157 | | 10/1998 | Stil et al. | 315/414 |
| 5,831,390 | | 11/1998 | Inoue et al. | 315/8 |
| 5,841,247 | | 11/1998 | Vriens | 315/370 |
| 6,018,217 | * | 1/2000 | Fondrk | 313/477 R |
| 6,177,758 | * | 1/2001 | Machara | 313/479 |

* cited by examiner

*Primary Examiner*—Don Wong
*Assistant Examiner*—Thuy Vinh Tran
(74) *Attorney, Agent, or Firm*—Antonelli, Terry, Stout & Kraus, LLP

(57) ABSTRACT

A cathode ray tube having an evacuated envelope including a panel section having a front face portion including a sloped sidewall, the sloped sidewall and an outer periphery portion being joined at mold match line, a neck containing therein an electron gun assembly, and a funnel section integrally coupling the panel section and the neck together. The sloped sidewall of the front faceplate has an angle which is in a range of 1.5 to 3 degrees to the tube axis, and a reinforcing band attached by a thermal shrink fit technique to and clamped around the outer periphery of the panel section. The reinforcing band is positioned around the panel section at a predefined position in which a circumferential bending line on the reinforcing band is offset from the mold match line of the cathode ray tube toward the neck.

11 Claims, 12 Drawing Sheets

CATHODE RAY TUBE

CROSS REFERENCE TO RELATED APPLICATION

This is a continuation of U.S. application Ser. No. 09/292,608, filed Apr. 15, 1999, now U.S. Pat. No. 6,150,760, the subject matter of which is incorporated by reference herein.

BACKGROUND OF THE INVENTION

The present invention relates generally to electron tube architectures and, more particularly, to cathode ray tubes having an evacuated envelope with a display window panel and a reinforcing member attached by thermal shrink-fit methods to the outer periphery thereof.

In recent years, cathode ray tubes (CRTs) have been widely employed as color image display devices in a variety of types of industrial and/or home-use electronic equipment. While other types of display devices, including liquid crystal display (LCD) panels and plasma displays have been developed to date, CRTs still offer enhanced picture image. displayabilities with good resolution. For this very reason, CRTs are adaptable for use as color display devices including, but not limited to, television (TV) receiver sets and monitor units for digital information processing equipment, such as workstations and personal computers (PCs).

One typical prior known CRT is constituted from an evacuated envelope which consists essentially of a display panel, a cone-shaped section known as a "funnel", and a neck. The panel includes a front faceplate having an inner surface on which a phosphor screen is formed. In the neck there is provided an electron gun assembly for generating one or more electron beams, which extend in one plane toward the phosphor screen. The panel and neck are coupled together by the funnel.

The funnel has a deflection device mounted thereon. On the way to the phosphor screen, the electron beams emitted from the gun are deflected across the phosphor screen by means of the deflection device.

The electron gun embedded in the CRT neck is designed to include several electrodes, such as a "cathode", a control electrode, a focus electrode, and an accelerating electrode. After being emitted by the cathode electrode, each beam of electrons arrives at the control electrode, which is responsive to an electrical signal supplied thereto for modulating the electron beam. The modulated beam then travels through the focus electrode and acceleration electrode. When penetrating these electrodes, the beam is given an electromagnetic force so as to be reshaped into a prespecified cross-section. Upon impinging on the phosphor screen, the beam forms a spot thereon. The electron beam, on its way to the phosphor screen, is deflected in the horizontal and vertical directions by means of the deflection device for formation of any desired picture images on the screen.

FIG. 8 schematically depicts in cross-section a typical structure of one prior known CRT of the in-line beam type. As shown herein, the CRT includes a front display panel 1 and a neck 3 which are coupled together by a funnel 2. The panel 1 has a reinforcing metal band 4 around its outer periphery clamped. This band 4 is a generally rectangularly looped strip for use as an implosion protector, and is also known as an "anti-implosion" band in some cases. A phosphor screen 8 is situated on the inside surface of the panel 1. The screen 8 has a large number of phosphor elements luminescing in red, green and blue colors for constitution of an image display screen. A shadow mask 9 acting as a color selection electrode is disposed in front of the inner surface of the display screen 8. The funnel 2 contains therein an inner shield 10 for blocking or shielding any externally attendant magnetic fields. Funnel 2 has a "shoulder" on which deflection yokes 11 are externally mounted for horizontal and vertical deflection of electron beams traveling inside of the CRT. An electron gun 12 is disposed in the neck 3 for emission of three separate electron beams B extending in one lateral plane, in the in-line configuration. The electron gun 12 is operatively associated with a magnetic device 13 for producing color purity correction and beam centering amendment. Additionally, panel 1 is bonded to funnel 2 at a joint or "junction" F providing a sealed environment within the CRT envelope.

In the CRT of FIG. 8, the panel 1 and funnel 2 plus neck 3 make up an evacuated envelope. Electron beams B emitted from the electron gun 12 are electromagnetically deflected in two directions—the horizontal and vertical directions—in the presence of deflection magnetic fields generated by deflection yokes 11 to thereby two-dimensionally scan over the phosphor display screen 8 for visualization of picture images thereon.

To preclude accidental implosion of the CRT, which has an internal vacuum, the tube is typically provided with a reinforcing metal band 4 that is mounted around the outer periphery of the panel 1 for implosion protection. In the CRT shown in FIG. 8, due to its inherent irregularity in shape, the external pressures applied thereto are complicated. It is not simply determinable how great a degree of external pressure acts on which part of the evacuated envelope. FIG. 9 presents a result of analysis indicating a typical distribution pattern of external force components applied to the CRT envelope. As seen from this diagram, the force acting inwardly of the CRT is maximal in strength at or near the "shoulder" of the envelope between the funnel 2 and neck 3, while the force acting outwardly of the CRT is maximal at the outer periphery of the panel 1. Generally, the implosion protective band 4 is clamped around the panel 1 at a location at which the outward pressure is applied, thereby protecting the CRT from implosion.

As shown in FIG. 10, the "anti-implosion" band 4 is designed to have a generally rectangular "closed-loop" shape with four rounded corners when seen from the side of the panel 1 after attachment to the CRT envelope. At the band corners, projected mount plates 14, called "lugs", are provided for suspension and rigid engagement of the CRT with the cabinet of a computer monitor or TV set.

In FIG. 11, there is shown an enlarged partial sectional view of a prior art CRT at one corner of the display panel 1. An anti-implosion metal band 41 is clamped around panel 1, with a glass cloth tape 5 sandwiched therebetween. Dotted line 6 is used to designate a mold match line of panel 1.

Typically the panel 1 consists of a front faceplate, with a slightly "domed" display window having a phosphor screen, and a generally rectangular frame or "periphery" 1P having opposite edges, one of which is bonded to the funnel's rim at joint F of FIG. 8 and the other of which is integrally molded along the mold match line G to the faceplate. The mold match line 6 is observable as a "seam" line on the outer periphery of panel 1, at a location at which the curved screen is abutted at an angle to the panel frame. The mold match section is a portion at which the outer periphery is maximal in the total loop length of panel 1.

Traditionally, the reinforcing band for implosion protection is a generally rectangularly looped flat strip which is rigidly secured to the CRT with the entire strip width being used for clamping. In particular, the band tightly clamps the CRT at or near the mold match portion with maximal compressive strength. The band more tightly clamps the CRT at a certain part extending from the mold match line up toward the screen, as compared to a region spanning from the mold match line to the panel periphery. To accomplish this, the band is made of a flat strip having a folded-back portion, or alternatively a thickness-increased portion, at its one edge on the side extending toward the screen. These portions will be collectively referred to herein as a "curled edge" or more simply as a "flip". The flip is laid out on the outer rounded surface of the screen, whereas a single-plate portion (thickness-reduced portion) of the strip is disposed on the outside walls of the panel frame. The band is bent at the single-plate (thin strip) portion so as to have a "V"-like bent portion 71, which is aligned with the mold match line 6, as shown in FIG. 11, to fit the curved outer shape of the panel 1. This permits the band to be in close contact with the curved panel surfaces.

In the past, the anti-implosion band has been clamped by "thermal shrink-fit" insertion methods. More specifically, the band is heated up prior to attachment to the CRT envelope so that the band thermally expands radially. The heated band is placed around the CRT panel and is then cooled down. The band thus shrinks to tightly clamp the outer periphery of CRT in a direction at right angles to its walls. In FIG. 11, arrow 41*a* designates the strength of the clamping force at a single-plate portion of the band, while arrow 41*b* indicates the clamping force at the flip 41 thereof.

As the clamping force 41*b* on the curved surfaces of the screen is not perpendicular to the panel glass surface and the reinforcing band, this force is vectorially divided into a force component 41*c* normal thereto and a parallel force component 41*d*, as shown in FIG. 11. If the CRT envelope with the band attached thereto in this state is subject to thermal processing, then the band can badly behave to move or slip toward the panel front face due to a difference in thermal expansion coefficient between the band 4 and panel 1 in response to the parallel clamping force 41*d*.

One exemplary slipped band state after thermal processing is shown in FIG. 12. As shown herein, the metal band is moved so that its bent portion 71 is displaced from the mold match line 6 toward the panel front face (upwardly in the drawing). Such slipping of the band causes the band 4 to float at its "free" edge on the side of the CRT neck, resulting in a decrease in the strength of the panel-clamping force of the metal band.

Further, as the slipping of the band increases through successive heatup processes, the lugs 14 of FIG. 10, which are provided at the corners of band 4 for use in mounting the CRT in a monitor or TV cabinet, vary in position accordingly. This lug position variation can result in creation of gap spaces between the CRT and the cabinet. This in turn leads to a deficiency or lack of rigid engagement between them.

SUMMARY OF THE INVENTION

It is therefore an object of the present invention to provide an improved electron tube structure which is capable of avoiding the problems inherent in the prior art.

It is another object of this invention to provide an improved cathode ray tube (CRT) with a reinforcing band which is capable of retaining increased clamping forces even in those environments with increased temperature changes.

It is still another object of the present invention to provide a CRT with an implosion-protective band which is capable of retaining a maximized clamping ability even where temperature differences are significant between a display panel and the band, or alternatively even after having been subjected to thermal processing.

It is a further object of the present invention to provide a CRT with an implosion-protective band which is capable of constantly offering a maximized panel clamping ability regardless of being subjected to CRT heatup processes, while at the same time increasing the manufacturability thereof at low costs.

To attain the foregoing objects, the instant invention provides a specific CRT which includes a vacuum-evacuated envelope. The envelope in turn includes a front display panel having an inside surface on which a phosphor screen is formed, and a neck that is coupled by a cone-shaped funnel section to the panel and contains therein an electron gun assembly. A reinforcing member in the form of an implosion-protective band is attached by thermal shrink-fit techniques to the outer periphery of the panel to clamp it for eliminating or at least greatly suppressing any accidental CRT implosion. The implosion-protective band, also known as an "anti-implosion" band, may preferably be a generally rectangular closed-loop strip made of metallic materials. The strip is bent along its circumference thus defining a partially tapered band wall, which may resemble in shape a generally rectangular open-roof dome-like fence. Importantly, the band is pre-displaced on the panel so that the bent portion is offset in position from the panel's mold match line toward the neck of the CRT.

Preferably, the offset amount of the band's bent portion from the mold match line falls within a range of from 2 to 6 millimeters (mm).

The band also has a folded-back or "curled" edge portion providing a front flip, which has its turned-back end on the single-plate strip as placed at a selected position that is offset toward the CRT neck from the mold match line.

With such an arrangement, the CRT may retain the intended panel clamping force sufficiently to let the band tightly clamp the panel even after having been subjected to thermal processing.

These and other objects, features and advantages of the invention will be apparent from the following more particular description of preferred embodiments of the invention, as illustrated in the accompanying drawings.

DETAILED DESCRIPTION OF THE INVENTION

Figure 1:
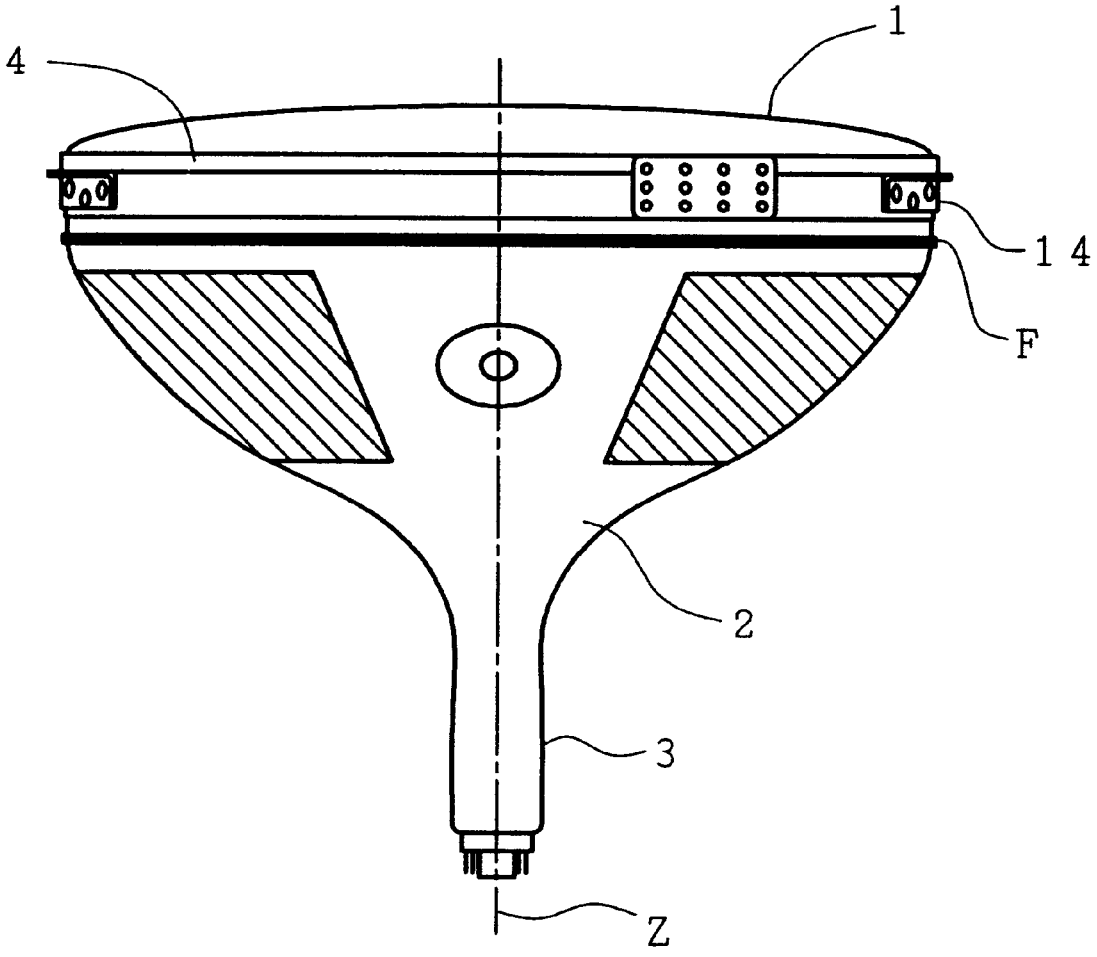
FIG. 1 is a diagram showing a side view of a CRT in accordance with one preferred embodiment of the present invention.

Referring now to FIG. 1, there is shown a color cathode ray tube (CRT) in accordance with one preferred embodiment of the invention. As shown, the CRT has a vacuum-evacuated envelope which includes a front display panel 1, a cone-shaped section 2, called a funnel, and a neck 3. The panel 1 has a phosphor screen formed on its inside surface, which screen is coated with a large number of phosphor elements luminescing in red, green, and blue colors. The neck 3 contains therein an electron gun assembly for generation of three separate electron beams which extend in one plane, representing the "in-line" plane configuration. The panel 1 and neck 3 are coupled together by the funnel 2. The panel 1 is integrally abutted and bonded with funnel 2 at a junction F, which defines a plane at right angles to the tube axis Z of the CRT.

A reinforcing band-like member 4 is tightly attached to the CRT envelope to rigidly clamp the outer periphery of panel 1 for protection of the CRT from accidental implosion. This implosion-protective or "anti-implosion" band 4 is illustratively a generally rectangular closed-loop strip made of metal. The anti-implosion band 4 is clamped around panel 1 as shown in FIG. 1 in a plane at right angles to the tube axis Z.

Figure 2:
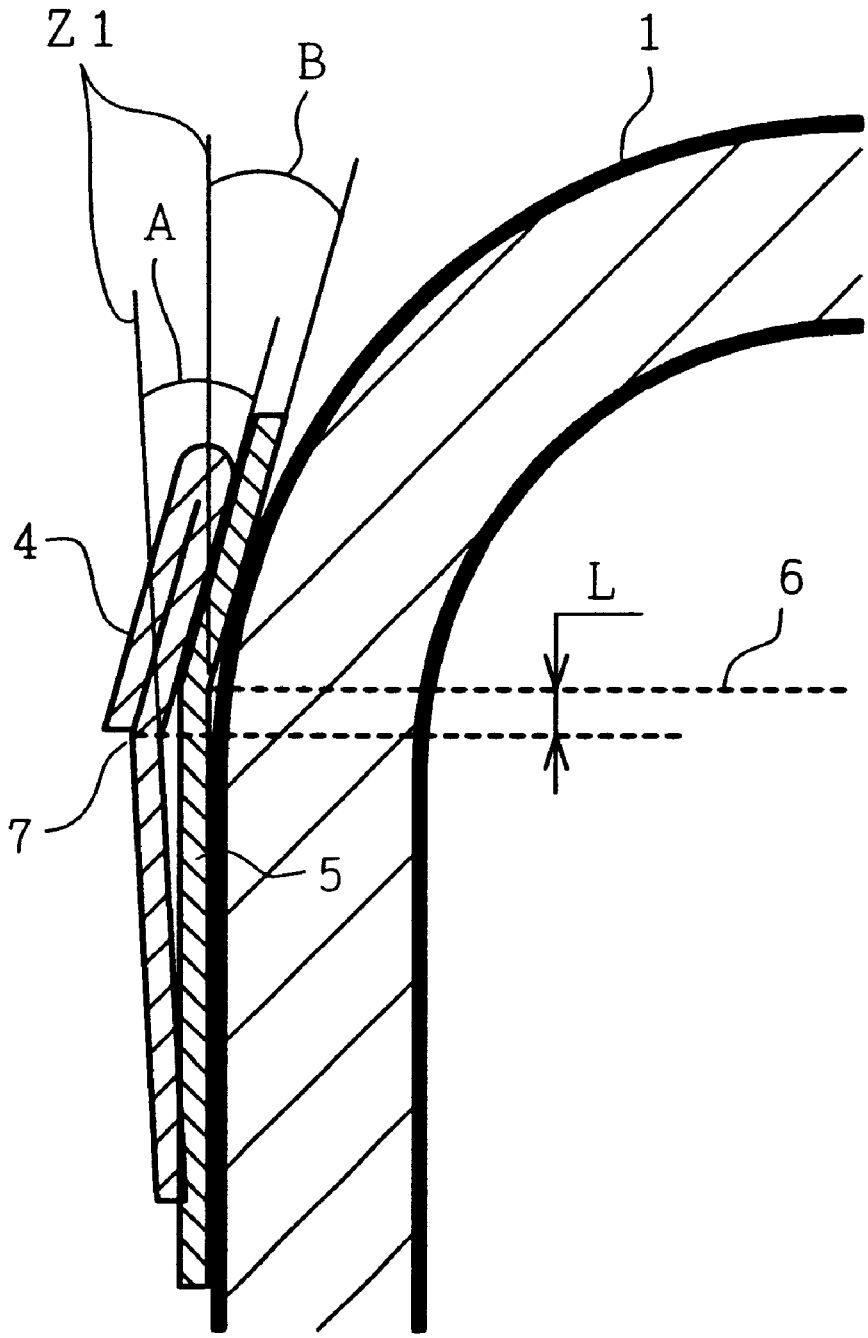
FIG. 2 is an enlarged partial sectional view of a display panel of the CRT shown in FIG. 1.
Figure 11:
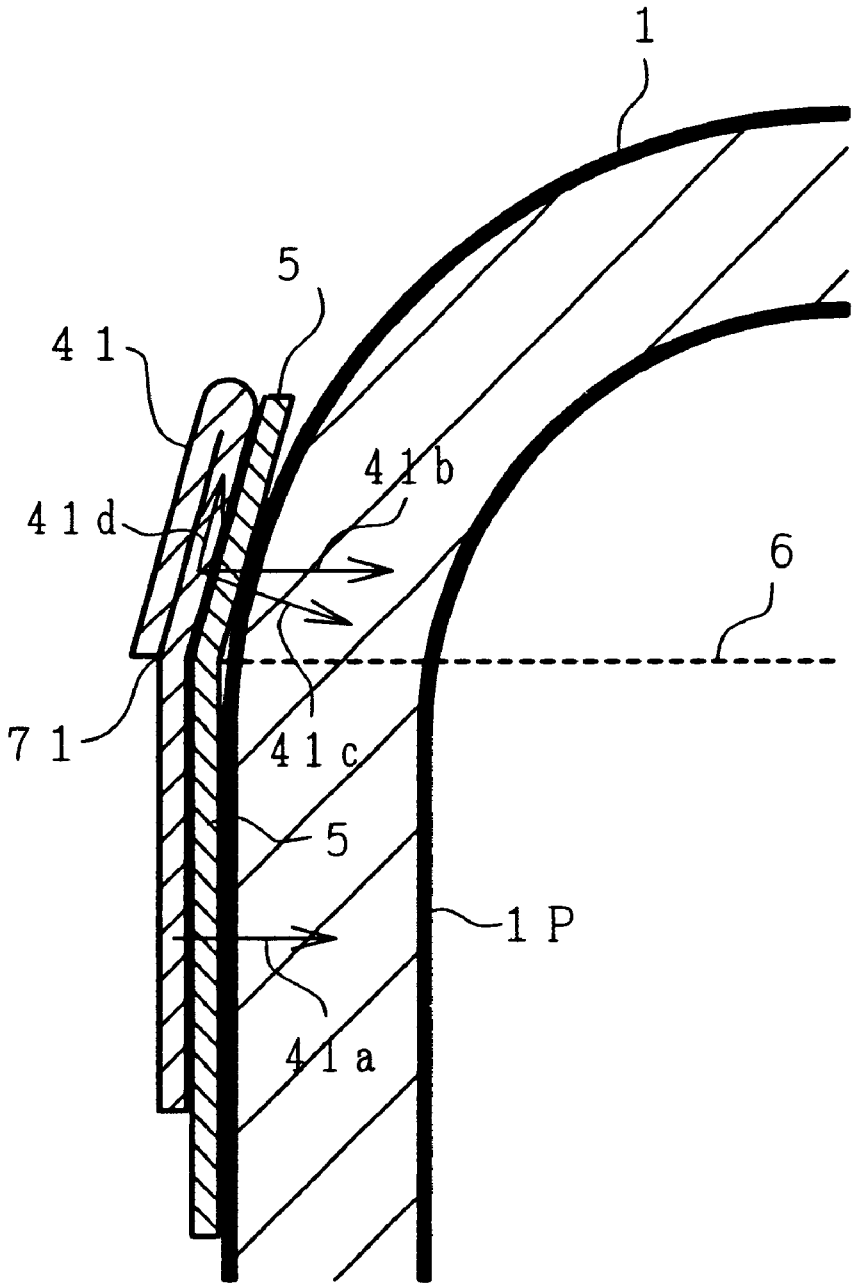
FIG. 11 (PRIOR ART)
FIG. 11 is an enlarged partial sectional view of a portion of a CRT envelope with the prior art band attached thereto.
Figure 12:
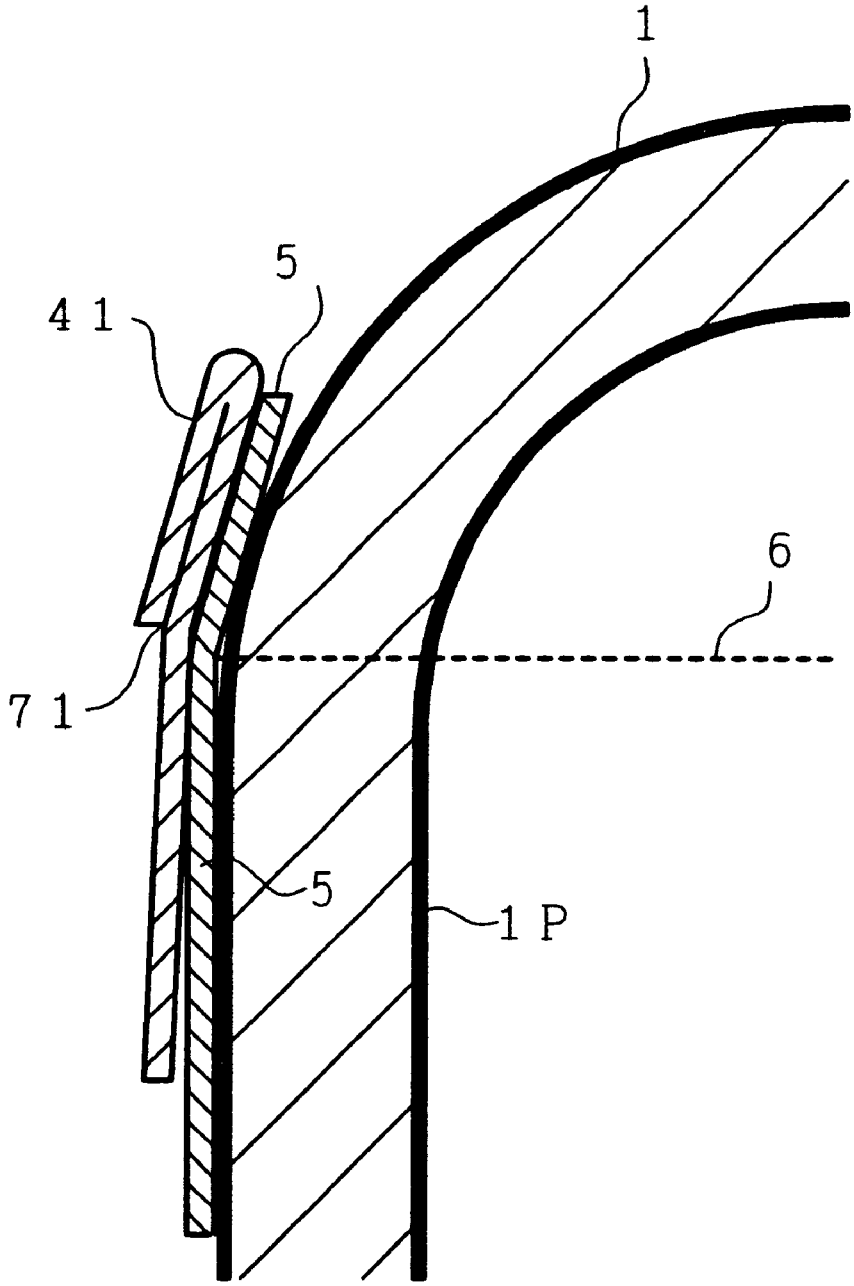
FIG. 12 (PRIOR ART)
FIG. 12 is an enlarged partial sectional view of a portion of a CRT showing the prior art band after completion of thermal processing.

FIG. 2 depicts an enlarged partly sectional view of the display panel 1 in the CRT envelope shown in FIG. 1 with the anti-implosion metal band 4 clamped thereon. Like parts or components are designated by like reference characters used in FIG. 11.

As shown in FIG. 2, the anti-implosion metal band 4 is attached to the side walls of the panel 1 with a spacer 5 sandwiched therebetween. The spacer 5 may be a glass cloth tape. The metal band 4 may illustratively consist of an approximately rectangularly looped strip which is bent inwardly—namely toward panel 11—at a portion 7 into a "V"-shaped or angle bracket ("<")-like cross-section along its circumference, thus partly resembling in shape an open-roof dome. The strip has opposite side edges, one of which is folded back or "curled" providing a "flip" on the bent walls. The metal band 4 is laid out at a carefully selected position to locate the bent portion 7 so as to be pre-displaced or offset by a predefined distance—say, pre-offset amount L—from the mold match line 6 the of panel 1 toward the CRT neck 3 (downward in the drawing).

The metal band 4 for CRT implosion protection is attached to the display panel 1 as follows. First prepare a looped strip to form the metal band 4. This band has a total loop length, along its inner wall surfaces, which is slightly smaller than the overall outer peripheral length around the panel as measured along the mold match line 6. In other words, the inner diagonal dimension of band 4 is less, by a little bit, than the outer diagonal size of panel 1. Then, the band 4 is heated to allow it to thermally expand so that the heated band can readily be put around the panel 1. Thereafter, upon cooling down, the band 4 shrinks to tightly clamp the sidewalls of panel 1 with an increased clamping force strength due to such cool-down shrinkage.

During clamp-mounting of the anti-implosion metal band 4, if the band's loop size along its inner faces relative to the outer panel size is too small then excessively increased heatup temperatures will be required; conversely, if the band size is too large, then it will no longer be possible to achieve the intended clamping force sufficient to provide a tight clamping of the CRT envelope structure for implosion protection. The "inherent" loop size of band 4 at room temperature prior to attachment to the CRT envelope is variable depending upon the metallic materials used therefor. Typically, the band 4 is made from iron with an electroplated layer coated thereon for corrosion protection.

In cases where the panel 1 comes with an antistatic film and/or nonglare film formed on a front face thereof, CRTs with the anti-implosion metal band clamped thereon are expected to experience thermal processing at high temperatures, such as 130° or more, in the manufacture thereof. Prior to such heatup processes the metal band is offset to position its bent portion 7 so as to be pre-displaced toward the CRT neck 3 from the mold match line 6 of panel 1. And, after the heatup process, the resulting CRTs are handled such that the metal band clamping the panel 1 is kept offset from mold match line 6 toward neck 3.

The glass-cloth tape spacer 5 inserted between the panel 1 and band 4 is provided for use in protecting panel glass surfaces from physical damage or "scars" otherwise occurring due to unwanted contact by the metal band 4 therewith. The tape 5 may alternatively be made from any other suitable "cushion" materials so long as they offer scratch protection as required. Additionally, tape 5 is resilient or elastic in nature and is hardly devoted to panel clamping for implosion elimination.

Very importantly, as shown in FIG. 2, the bent portion 7 of anti-implosion metal band 4 is placed at a selected position which is offset from the mold match line 6 toward the electron gun in the CRT neck 3. Also note that the single-plate portion of metal band 4 is bent to have the angle bracket (<)-like cross-section as shown in FIG. 2. The bending angle A of such band 4 is set at approximately 5 degrees, more or less. Here, an angle B as defined between the flat sidewall of the panel 1 and the starting edge of its associative curved surface of the screen plate may typically fall within a range of from 2 to 3 degrees. In other words the band bend angle A is greater than the panel curvature angle B to make sure that band 4 acts to tightly clamp panel 1 with increased reliability and enhanced strength.

It should be noted that the pre-offset amount L of the band's bent portion 7 relative to the mold match line 6 is designed to be 2 millimeters (mm) or greater. This value setting is recommended because, if the offset value L were less than 2 mm, then the bent portion 7 is more likely to slip during manufacture to become aligned with mold match line 6, which would result in creation of the problems faced with the prior art, as described in the introductory part of this specification. On the contrary, if the offset L were less than 2 mm then the resultant CRTs manufactured through thermal processing might suffer from an increase in the amount of slippage of the band 4 toward the display panel front face side.

Also, preferably, the band offset value L may be set to be less than 6 mm. This value makes it possible to achieve a strong clamping force as required, without having to excessively increase the along-the-tube-axis length (width) of the band 4. If the offset L were greater than 6 mm with the same band width as the prior art, then the gap space which occurs between the panel 1 and the band 4 can increase in dimension, thereby narrowing the net clamping area of the band 4 facing the periphery of panel 1, which results in a decrease in strength or "functionality" of the clamping forces applied to panel 1. On the other hand, if the offset L is allowed to be greater than 6 mm, the clamping force reduction may be eliminated by widening the band 4 if needed. Especially, letting the single-plate portion of the band 4 on the panel periphery be longer than the folded-back "front flip" of band 4 makes it possible to obtain a stronger clamp force-acting on the panel periphery side.

In summary, designing the band offset L ranging from 2 to 6 mm may ensure that an almost "ideal" clamping force is obtainable even where the metal band 4 is decreased in Width along the CRT tube axis Z. The "band offset 2–6 mm setting" feature may also make it possible to achieve a successful implosion protection ability or protectability without letting band 4 move or slip toward the panel's front face.

It would be readily appreciated by experts in the CRT art from FIG. 2 that although in this illustrative embodiment the bent portion 7 of the anti-implosion metal band 4 is pre-offset from the mold match line 6 along the tube axis direction of the CRT permitting the presence of a gap space on the panel side of such bent portion 7, successful clamping is still obtainable by both the single-plate portion of the band 4 on the panel 1 at the CRT neck side and its "curled" front flip on the panel front face side, which portions are of the "<"-like shape as stated above. In addition, a sufficient, clamping force is achievable at the opposite side edges of band 4 thereby making it possible to eliminate undesired band slip or "migration" during thermal processing, which in turn enables constant establishment of a stable envelope clamping ability as a whole. Finally, more reliable and stable panel clamp forces are retainable on the opposite edges of the anti-implosion metal band 4 along the tube axis even while the CRT envelope undergoes heatup processes.

As far as the single-plate portion of the anti-implosion metal band 4 is concerned, the panel clamp force might be equal to that of the prior art with, its bent portion 7 simply aligned the mold match line 6.

It is also important in the CRT embodying the invention that, as better seen from FIG. 2, the front flip of the metal band 4 is long enough to let its turned-back distal end terminate at the bent portion 7 thereof. This makes it possible to provide enhanced clamping performance with respect to curved portions of the display screen of the panel 1.

It has been stated that, with reference to the illustrative embodiment of FIGS. 1–2, the anti-implosion metal band 4 clamped around the panel 1 is specifically designed to have its single-plate portion disposed at the neck side part of panel 1 and the front flip on the display screen side thereof, which portions are both used to clamp panel 1 to thereby prevent band 4 from unwanted slip movement during CRT heatup processes, which in turn enables achievement of enhanced implosion protectability.

Figure 3:
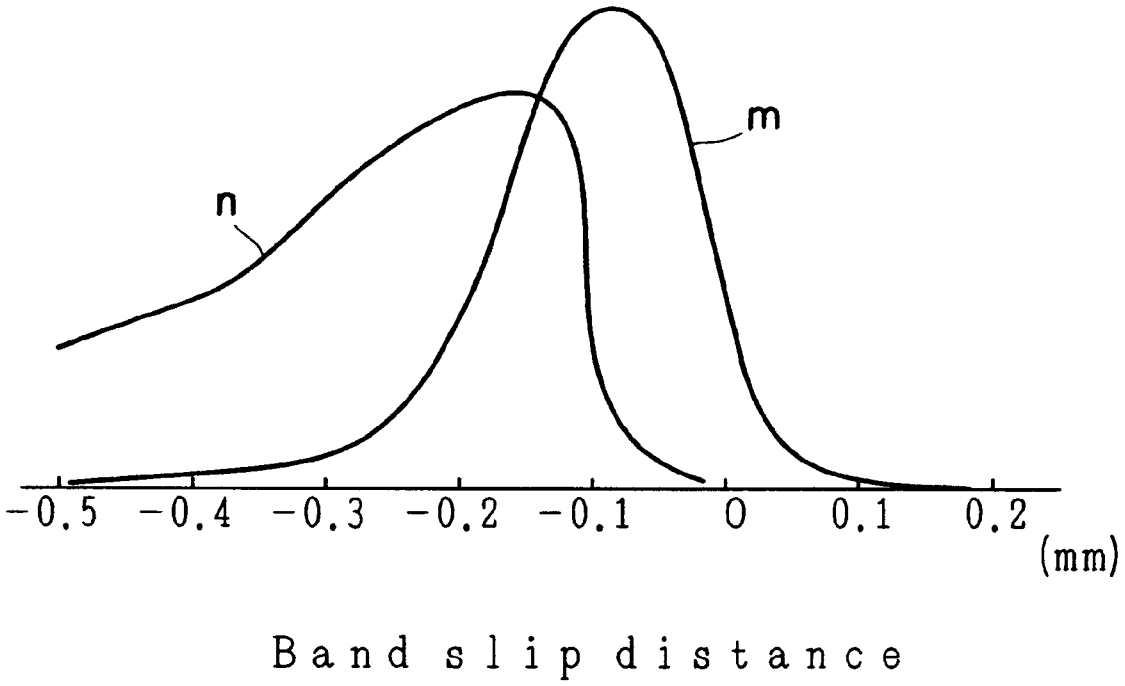
FIG. 3 is a graph showing a distance of movement of a reinforcing band attached to the CRT panel along with that in the prior art for comparison.

One typical experimental result is presented in FIG. 3. This graph indicates several measurements of slip distances along the CRT tube axis of bent portions 7 of those anti-implosion metal bands which are attached to CRT envelopes, which are each offset by 3 mm from the mold match line 6 toward the CRT neck side in accordance with the "band offset 2–6 mm setup" feature of the invention. The band slip distances of such CRTs embodying the invention are designated by curve m in FIG. 3. For comparison, band slip distances of prior art CRTs are shown by curve n in FIG. 3, which are such that each band's bent portion 7 is simply aligned with mold match line 6.

Note that for this experiment, fifty five CRT samples were prepared, each employing the "band offset 2–6 mm setup" feature of the invention. The same number of other CRT samples were prepared for comparison, which samples lacked the feature of the invention. As seen from FIG. 3, of the CRTs embodying the invention, ninety percent of them fall within a limited band slip range of from zero to −2 mm with the center of distribution staying at or near −0.1 mm, where the minus (−) sign as used herein refers to "forward" movements of the band toward the panel front face, whereas the plus sign (+) indicates "backward" band movements toward the CRT neck side. This well demonstrates that most CRTs of the present invention as shown by curve m remain free from the risk of band slip or "migration" otherwise occurring during thermal processing in the manufacture thereof. On the contrary, the comparative CRTs with the prior art metal band structure as shown by curve n exhibited longer band slip distances. In the worst case, some of them suffered from a maximum band migration as large as −1.2 mm.

It is noted here that the pre-displacement of the anti-implosion band 4 to position its bent portion 7 so as to be offset from the mold match line 6 of the panel 1 might cause certain mass-production inaccuracies. However, such errors are as little as 1 mm or therearound. This means that it is possible to retain the bent portion 7 in position to reside at or at least near those positions as offset from the mold match line 6 toward the CRT neck 3.

Also note that while the clamped metal band 4 slightly moves after heatup processes, such movement is rather "negligible" in actual mass-production, with the band displacement being within a very limited range of from −0.5 mm to +0.2 mm. Such limited band slippage causes no serious reduction of clamping force strength. The above experimentation suggests that the "<"-like bent anti-implosion metal band 4 incorporating the principles of the present invention may retain increased or maximized panel clamping performance at all times at the neck-side edge of its single-plate part. This in turn enhances the manufacturing process, while increasing product manageability.

Additionally, in the experimentation described above, the band offset value L and the band slip distance are each determined by measuring a distance between the panel top face and the mold match line 6 along the tube axis Z, and measuring the along the tube axis distance between such panel top face and the bent portion 7 of the band 4, and then obtaining through mathematical subtraction a difference between the two.

A further advantage of the CRT shown in FIGS. 1–2 embodying the invention is that, as the metal band slip distance due to the heatup processes may be limited to a narrowed range, as discussed above, the lugs at the four corners of the anti-implosion metal band 4 may also be retained in position with limited movement. This in turn facilitates the mounting of the CRT in the cabinets of TV sets or computer monitors.

Figure 4:
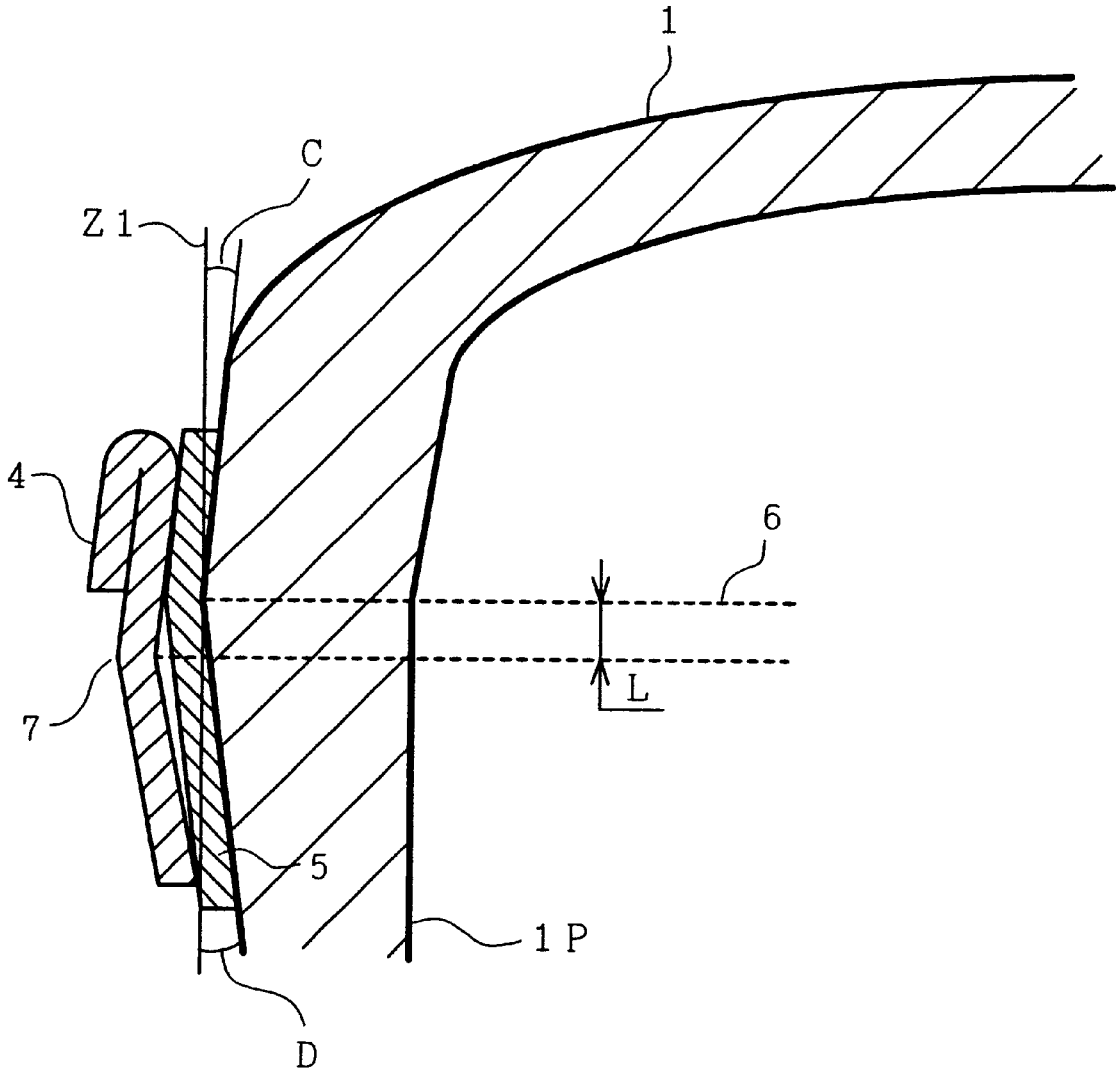
FIGS. 4 to 7 are diagrams each depicting an enlarged partial sectional view of a CRT embodying the invention.

Turning now to FIG. 4, there is shown an enlarged partial sectional view of an implosion protection-enhanced CRT in accordance with another embodiment of the invention. This CRT comes with its anti-implosion metal band 4 clamped around a display panel 1, which is similar to that shown in FIG. 2, except that the panel 1 is inwardly slanted or sloped on its outer sidewall at or near the mold match line 6. The panel 1 has a slant-cut display window sidewall that is at an angle C relative to a reference line Z1 extending parallel to the CRT tube axis Z in FIG. 1. The panel periphery 1P is sloped at an angle D to reference line Z1, as shown in FIG. 4. The angle C is typically designed to fall within a range of 1.5 to 3 degrees with a tolerance of approximately 1.5 degrees. The angle D is from 3 to 4.5 degrees with a tolerance of about 2 degrees.

With such a slant panel sidewall structure, the anti-implosion metal band 4 is clamped around panel 1 with a spacer 5 inserted therebetween. The metal band 4 is inwardly bent at an angle of about 5 degrees at its single-plate portion to form a bent portion 7. This portion is offset in position from the mold match line 6 of the panel 1 toward the CRT neck 3 in a manner similar to that in the previous embodiment depicted in FIG. 2. As in the previous embodiment, the offset amount L of band 4 is set ranging from 2 to 6 mm—here, 2 mm. Band 4 is folded back or "curled" at one end on the display front face side to form a "front flip" similar to that shown in FIG. 2. This front flip has a turned-back edge, which is substantially aligned with the mold match line 6 of panel 1, as shown in FIG. 4, although the flip may be elongated letting the end extend to the bent portion 7 of band 4 as in the FIG. 2 embodiment.

With such an arrangement, even where the periphery IP has the angle D to the tube axis Z at or near the mold match line 6, the anti-implosion metal band 4 is employable to offer an increased panel clamping force for reinforcement of the CRT envelope, thereby further increasing the implosion protectability. Thus, similar effects and advantages as in the previous embodiment may be obtainable.

Figure 5:
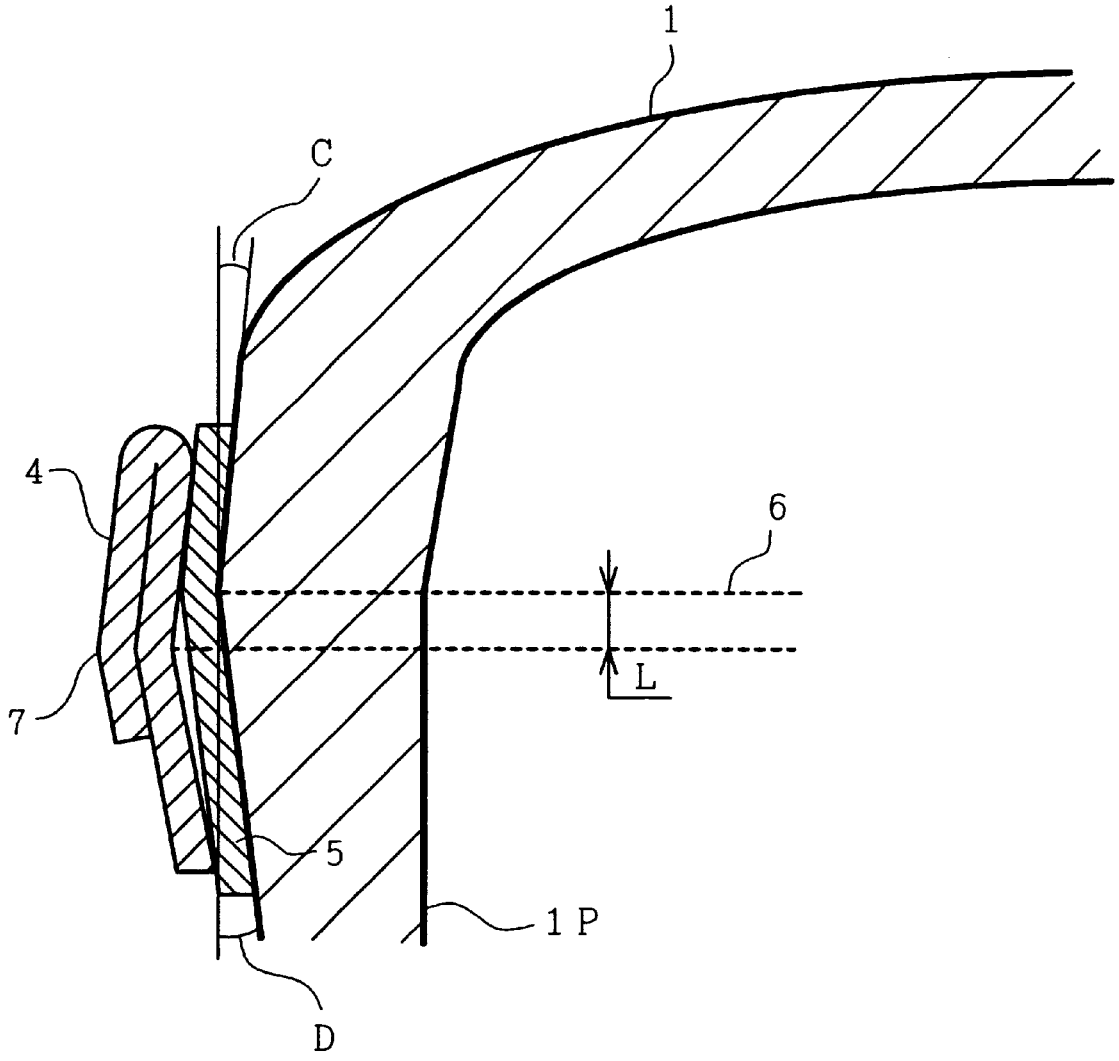

A CRT also embodying the invention is shown in FIG. 5. This CRT is similar to that shown in FIG. 4 with the front flip of the anti-implosion metal band 4 being elongated, causing its turned-back edge to go beyond the bent portion 7 so as to reside at a position on the CRT neck side rather than the display window side. Such an elongated flip results in a double-layered structure at the bent portion 7 of the metal band 4, increasing the thickness of the metal band 4. This enables band 4 to offer a further increased clamping force against the panel 1 in a widened area, which in turn makes it possible to further enhance the CRT in a implosion protectability.

Figure 6:
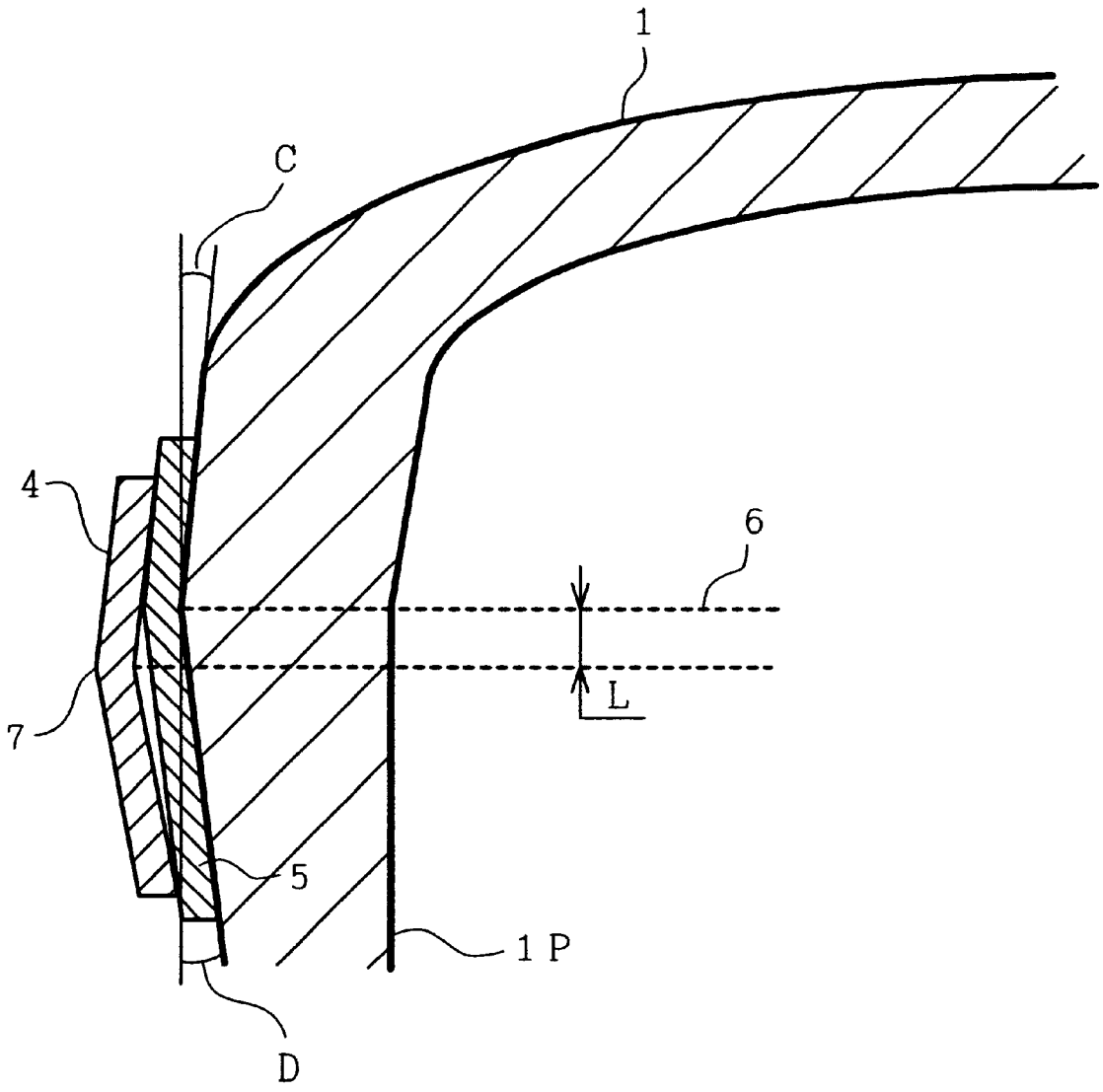

The CRT shown in FIG. 6 is similar to that of FIG. 4 with the bent anti-implosion metal band in FIG. 4 being replaced by a "flip-less" metal band 4, which consists of a single-plate strip bent at portion 7. Elimination of the front flip of metal band 4 reduces the complexity of the structure to thereby increase the manufacturability, while simultaneously rendering band 4 thermally expandable at low temperatures with less heatup energy. In addition, the "single-plate" band 4 offers clamp-force controllability through plate thickness varying procedures.

Figure 7:
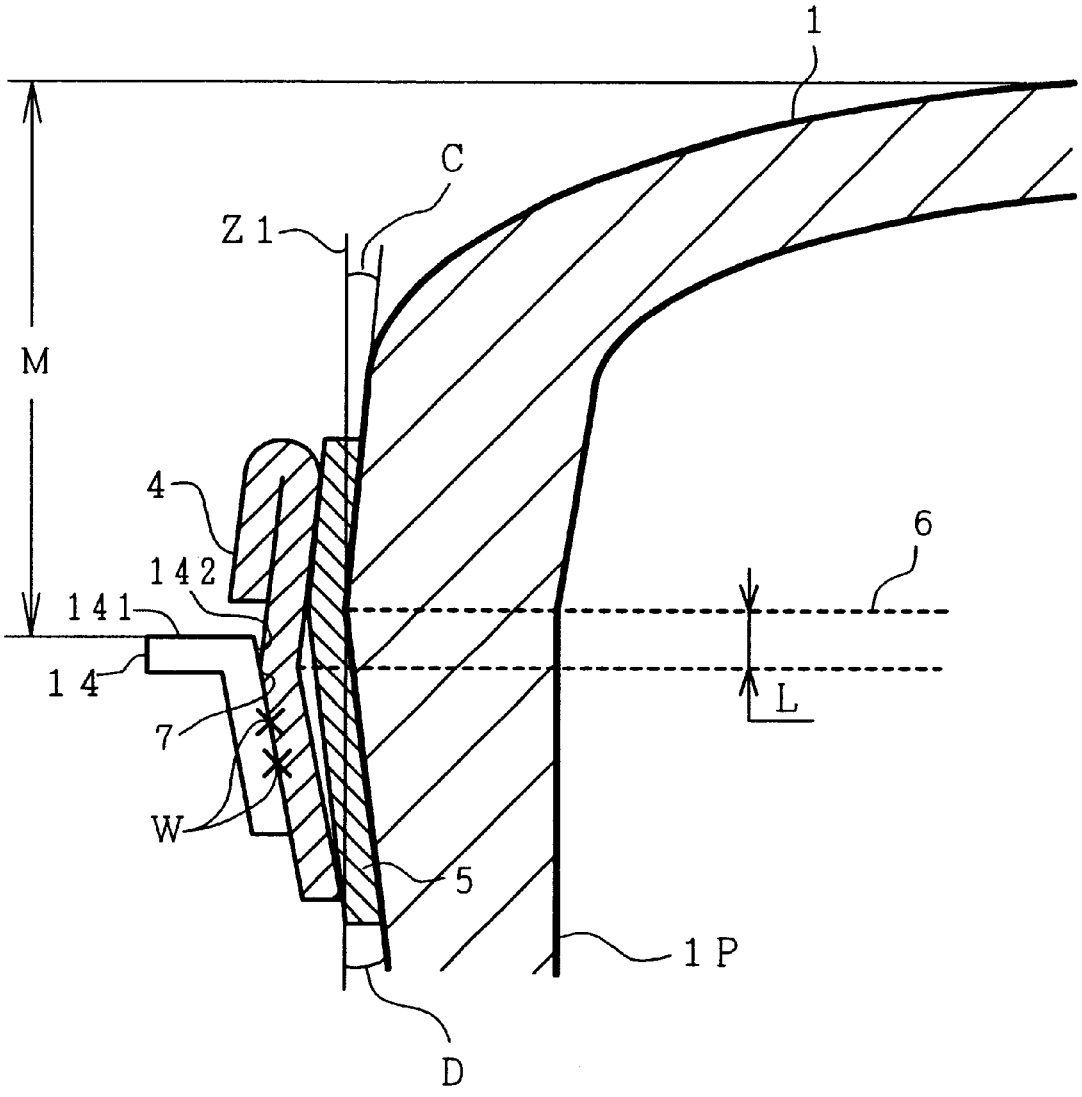
Figure 8:
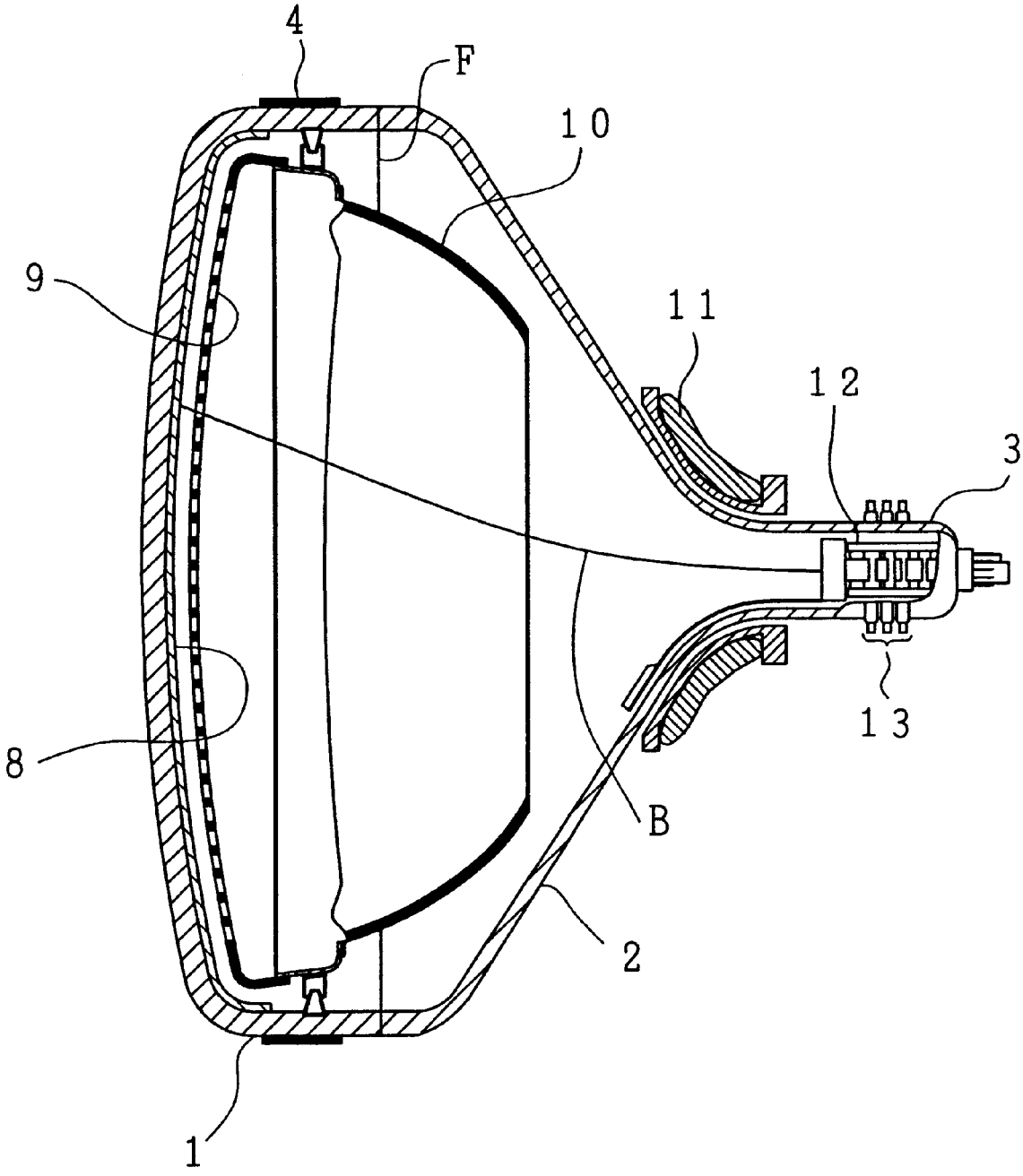
FIG. 8 PRIOR ART
FIG. 8 is a diagram which illustrates a typical CRT in cross-section.
Figure 9:
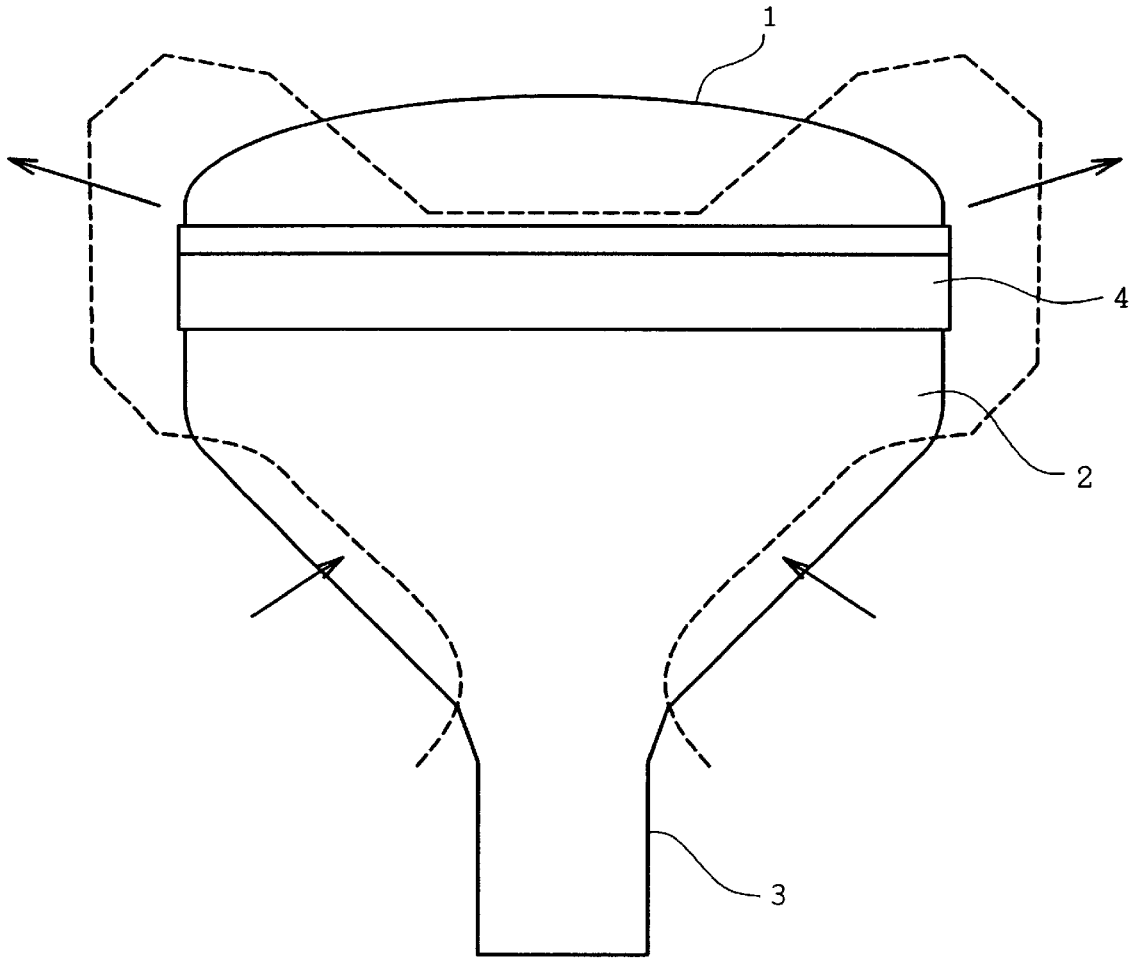
FIG. 9 PRIOR ART
FIG. 9 is a pictorial representation of a distribution pattern of forces applied to an evacuated envelope of the CRT.
Figure 10:
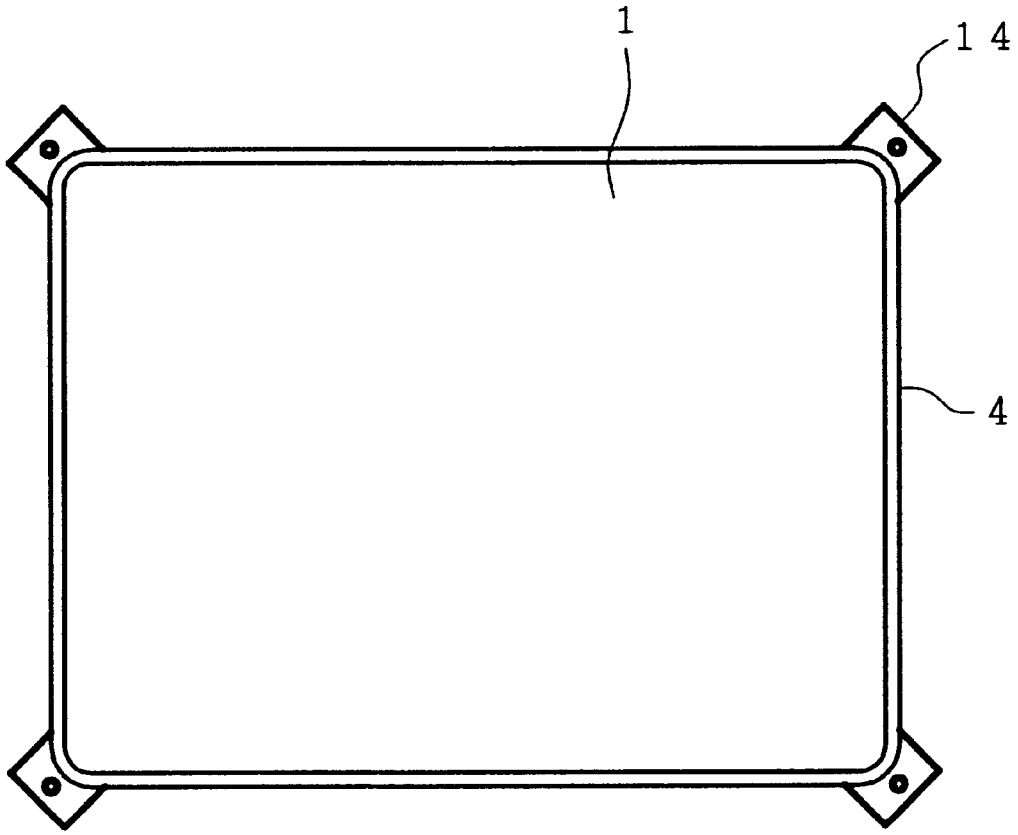
FIG. 10 PRIOR ART
FIG. 10 is a diagram which depicts one typical reinforcing band to be clamped around a CRT display panel.

A CRT shown in FIG. 7 is similar to that of FIG. 4 with lugs 14 (only one is visible) soldered to the anti-implosion metal band 4. These lugs 14 are CRT suspension elements for use in mounting the CRT in a cabinet (not shown). Each lug 14 is illustratively a flat plate as bent providing a base and an extension 141. The lug base has its bottom surface 142 rigidly secured via a solder portion W to the single-plate portion of the metal band 4. The extension 141 projects outwardly in a direction parallel to the mold match line 6 of the panel 1. Another lug (not visible in FIG. 7) on the opposite sidewall of panel 1 is similarly structured so that a substantially constant distance M is maintained between the display window's front top face and those surfaces (upper surfaces in the drawing) of such lug extensions 141.

As shown in FIG. 7, the lug extension 141 is at a specific position midway between the mold match line 6 and the "offset" bent portion 7 of the ml metal band 4. The soldered portion W sandwiched between the lug 14 and band 4 overlies the sloped-at-angle-D, which is on the CRT neck 3 side rather than on the side of display window. The bent portion 7 is between the mold match line 6 and solder W. With such a "lug-integrated" metal band structure, it is no longer required that the lug surface 142 be adjusted in mount angle to be identical to the angle of the band bent portion 7 at separate process steps in the manufacture of such a CRT. This makes it possible to reduce the complexity of manufacture of the lugs 14, while at the same time making the soldering of the lugs 14 to band 4 easier.

It has been described that CRTs employing the anti-implosion metal band incorporating the principles of the present invention are capable of eliminating, or at least greatly suppressing, any possible displacement of the metal band due to thermal processing to thereby enable successful retention of a sufficiently significant clamping force for CRT implosion protection. Another advantage of the invention lies in the fact that the CRT has less band slip, thus increasing the mass-productivity of such CRTs with reinforcing bands of any desired clamping force strengths, while increasing the yield and reducing costs. Especially, in view of the fact that large-screen CRTs require increased panel clamping forces, the invention is applicable to CRTs as large as 17 inches in viewable image size or greater.

Although the invention has been disclosed and illustrated with reference to particular embodiments, the principles involved are susceptible for use in numerous other embodiments which will be apparent to persons skilled in the art. The invention is, therefore, to be limited only as indicated by the scope of the appended claims.

What is claimed is:

1. A cathode ray tube comprising:

an evacuated envelope including a panel section having a front face portion including a sloped sidewall, said sloped sidewall and an outer periphery portion being joined at mold match line, a neck containing therein an electron gun assembly, and a funnel section integrally coupling said panel section and said neck together;

said sloped sidewall of said front faceplate having an angle which is in a range of 1.5 to 3 degrees to the tube axis;

a thermal shrink fitted reinforcing band clamped around the outer periphery of said panel section;

said reinforcing band being positioned around said panel section at a predefined position in which a circumferential bending line on said reinforcing band is offset from said mold match line of said cathode ray tube toward said neck.

2. The cathode ray tube according to claim 1, wherein said reinforcing band is provided with lugs.

3. The cathode ray tube according to claim 1, wherein said circumferential bending line of said reinforcing band is offset from said mold match line by 2 to 6 millimeters (mm).

4. The cathode ray tube according to claim 3, wherein said reinforcing band comprises a looped strip having one edge folded back over said strip so as to face in the direction of said neck to form a flap with its turned-back edge residing at a predetermined position which is offset from said mold match line toward said neck.

5. The cathode ray tube according to claim 3, wherein said reinforcing band comprises a looped strip having one edge folded back over said strip so as to face in the direction of said neck thereby defining a flap with its turned-back edge residing at a predetermined position which is offset from said bending line toward said face plate.

6. A cathode ray tube comprising:

an evacuated envelope including a panel section having a front face portion including a sloped sidewall, said sloped sidewall and an outer periphery portion being joined at mold match line, a neck containing therein an electron gun assembly, and a funnel section integrally coupling said panel section and said neck together;

said outer periphery portion having an angle which is in a range of 3 to 4.5 degrees to the tube axis; and a thermal shrink fitted reinforcing band clamped around the outer periphery of said panel section;

said reinforcing band being positioned around said panel section at a predefined position in which a circumferential bending line on said reinforcing band is offset from said mold match line of said cathode ray tube toward said neck.

7. The cathode ray tube according to claim 6, wherein said reinforcing band is provided with at least one lug.

8. The cathode ray tube according to claim 6, wherein a sloped sidewall of said front faceplate has an angle which is in a range of 1.5 to 3 degrees to the tube axis.

9. The cathode ray tube according to claim 8, wherein said circumferential bending line is offset from the mold match line by 2 to 6 millimeters (mm).

10. The cathode ray tube according to claim 9, wherein said reinforcing band comprises a looped strip having one edge folded back over said strip so as to face in the direction of said neck to form a flap with its turned-back edge residing at a predetermined position which is offset from said mold match line toward said neck.

11. The cathode ray tube according to claim 9, wherein said reinforcing band comprises a looped strip having one edge folded back over said strip so as to face in the direction of said neck thereby defining a flap with its turned-back edge residing at a predetermined position which is offset from said bending line toward said face plate.

* * * * *